US011091287B1

(12) United States Patent
Krechowiecki

(10) Patent No.: US 11,091,287 B1
(45) Date of Patent: Aug. 17, 2021

(54) BAG HOLDER

(71) Applicant: Jodi Krechowiecki, Regina (CA)

(72) Inventor: Jodi Krechowiecki, Regina (CA)

( * ) Notice: Subject to any disclaimer, the term of this patent is extended or adjusted under 35 U.S.C. 154(b) by 0 days.

(21) Appl. No.: 17/076,800

(22) Filed: Oct. 21, 2020

Related U.S. Application Data

(60) Provisional application No. 62/924,076, filed on Oct. 21, 2019.

(51) Int. Cl.
*B65B 67/12* (2006.01)
*A47L 15/50* (2006.01)

(52) U.S. Cl.
CPC ..... *B65B 67/1233* (2013.01); *A47L 15/505* (2013.01); *B65B 67/12* (2013.01); *B65B 67/1227* (2013.01); *B65B 67/1238* (2013.01)

(58) Field of Classification Search
CPC . B65B 67/1233; B65B 67/1227; B65B 67/12; B65B 67/1238; A47L 15/505
USPC ..... 248/99; 141/10, 114, 311 R, 312, 331, 141/316, 332
See application file for complete search history.

(56) References Cited

U.S. PATENT DOCUMENTS 5,188,244 A * 2/1993 Hollstegge ..... A47L 19/04 211/13.1
5,673,446 A * 10/1997 Moen ..... A47C 21/028 5/489
5,901,861 A * 5/1999 Huguet ..... F26B 25/18 211/85.15
5,918,651 A * 7/1999 Gazdy ..... B65B 67/1277 141/391
6,152,407 A * 11/2000 McKenzie ..... B65B 67/1227 248/95
6,640,982 B1 * 11/2003 Bjerke ..... A47L 19/04 211/85.15
6,698,474 B1 * 3/2004 Trsek ..... B65B 67/1255 141/315
2002/0144963 A1 * 10/2002 Mood ..... A47L 15/505 211/85.15
2011/0108682 A1 * 5/2011 Boaz ..... A47B 81/00 248/99
2011/0315831 A1 * 12/2011 Roberts ..... B65B 67/1205 248/100

(Continued)

FOREIGN PATENT DOCUMENTS

CH 598057 A5 * 4/1978 ..... B65B 67/1227
WO WO-9716349 A1 * 5/1997 ..... B65B 67/1266

*Primary Examiner* — Kimberly T Wood
(74) *Attorney, Agent, or Firm* — QuickPatents, LLC; Kevin Prince

(57) ABSTRACT

A bag holding system facilitates filling a plastic bag while the plastic bag is supported on a support surface, and further provides for facilitating washing of the plastic bag in a dishwasher. A base has a bottom member and two side members that extend upwardly from the base at two opposing sides thereof. A V-shaped support frame has a bottom frame and two side frames extending upwardly from the bottom frame at two opposing sides thereof. The support frame is adapted to be inserted into the baes between the two side members of the base, the base holding the support frame in a substantially upright position. A funnel has bottom panel with a fill aperture therethrough and two side panels projecting upwardly therefrom at two opposing sides of the bottom panel. Each side panel further includes an outwardly-extending flange at a top side thereof.

6 Claims, 4 Drawing Sheets

(56) References Cited

U.S. PATENT DOCUMENTS

| | | | | |
|---|---|---|---|---|
| 2012/0279610 | A1* | 11/2012 | Krum | B65B 67/1205 141/10 |
| 2014/0314342 | A1* | 10/2014 | Verma | B65D 33/007 383/34 |
| 2016/0031586 | A1* | 2/2016 | Untch | B65B 1/16 220/639 |
| 2016/0264343 | A1* | 9/2016 | Moulton | B65B 67/1238 |
| 2017/0113911 | A1* | 4/2017 | Fox | G09F 15/0056 |

* cited by examiner

BAG HOLDER

CROSS REFERENCE TO RELATED APPLICATIONS

This application claims the benefit of U.S. Provisional Application 62/924,076, filed on Oct. 21, 2019, and incorporated herein by reference.

STATEMENT REGARDING FEDERALLY SPONSORED RESEARCH AND DEVELOPMENT

Not Applicable.

FIELD OF THE INVENTION

This invention relates to plastic bags, and more particularly to a system for facilitating filling and washing plastic bags.

BACKGROUND

Plastic bags, such as typical one-gallon kitchen bags, are notoriously difficult to fill with liquids such as hot grease from a pan. It takes two hands to hold such bags open, which then requires another person to pour the liquid or other substance into the open bag. All the while a person's hands are dangerously close to the bag opening and prone to scalding in the case where the substance is a hot liquid.

Moreover, many people prefer to reuse such plastic bags at least a couple of times in order to avoid adding plastic to landfills more than necessary, but there is no easy means of supporting such bags in a dishwasher, inverted, such that the plastic bag is sufficiently clean. Merely placing such plastic bags inverted over prongs of a dish rack in the dishwasher does not retain the plastic bags in position sufficiently to overcome the pressure of hot water spray in the dishwasher, and consequently such plastic bags are blown off of the dish rack and are often not sufficiently cleaned as a result.

Therefore, there is a need for a system that facilitates both pouring substances into a plastic bag safely and easily, and that also facilitates the washing of such plastic bags in a dishwasher. Such a needed invention would be made from dishwasher-safe materials, and would be easy to use and relatively inexpensive to manufacture. The present invention accomplishes these objectives.

SUMMARY OF THE INVENTION

The present device is a bag holding system for facilitating filling a plastic bag with a substance while the plastic bag is supported on a support surface, such as a countertop. For example, the bag holding system may be used for filling a standard sealable plastic one-gallon kitchen bag with hot grease from a pan. The bag holding system further provides for facilitating washing of the plastic bag in a dishwasher that has a dish rack.

A base has a bottom member and two side members that extend upwardly from the base at two opposing sides thereof. A bottom side of the bottom member is adapted for contacting the support surface, and is preferably an elongated rectangle with the opposing sides being the long sides thereof.

A V-shaped support frame has a bottom frame and two side frames extending upwardly from the bottom frame at two opposing sides thereof. The support frame is adapted to be inserted into the baes between the two side members of the base, the base holding the support frame in a substantially upright position. Preferably the side frame includes one or more openings for facilitating the dishwasher washing the plastic bag, and specifically an inside surface of the plastic bag.

A resilient funnel has bottom panel with a fill aperture therethrough and two side panels projecting upwardly therefrom at two opposing sides of the bottom panel. Each side panel further includes an outwardly-extending flange at a top side thereof.

As such, with the base resting on the support surface, and with the support frame inserted into the base and held in the upright position, the funnel is inserted into the open end of the plastic bag. The plastic bag is then captured between the two side panels of the funnel and the two side frames of the support frame. The plastic bag is fillable by pouring the substance into the aperture of the funnel. In some embodiments the bottom panel of the funnel is sloped towards the aperture so that liquid impacting the bottom panel outside of the aperture will roll down into the aperture and ultimately into the plastic bag.

In an alternate use of the invention, the support frame is inserted into the open top end of the plastic bag. The support frame and the plastic bag are then inverted with the side frames pressed towards each other so that the support frame and the plastic bag may be inserted between prongs of the dish rack of the dishwasher. When released the resiliency of the support frame pushes the side frames outwardly towards the original uncompressed position to engage the dish rack to hold the plastic bag in place inverted in the dish rack.

The present invention is a system that facilitates both pouring substances into a plastic bag safely and easily, and that also facilitates the washing of such plastic bags in a dishwasher. The present invention is made from dishwasher-safe materials, and is easy to use and relatively inexpensive to manufacture. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
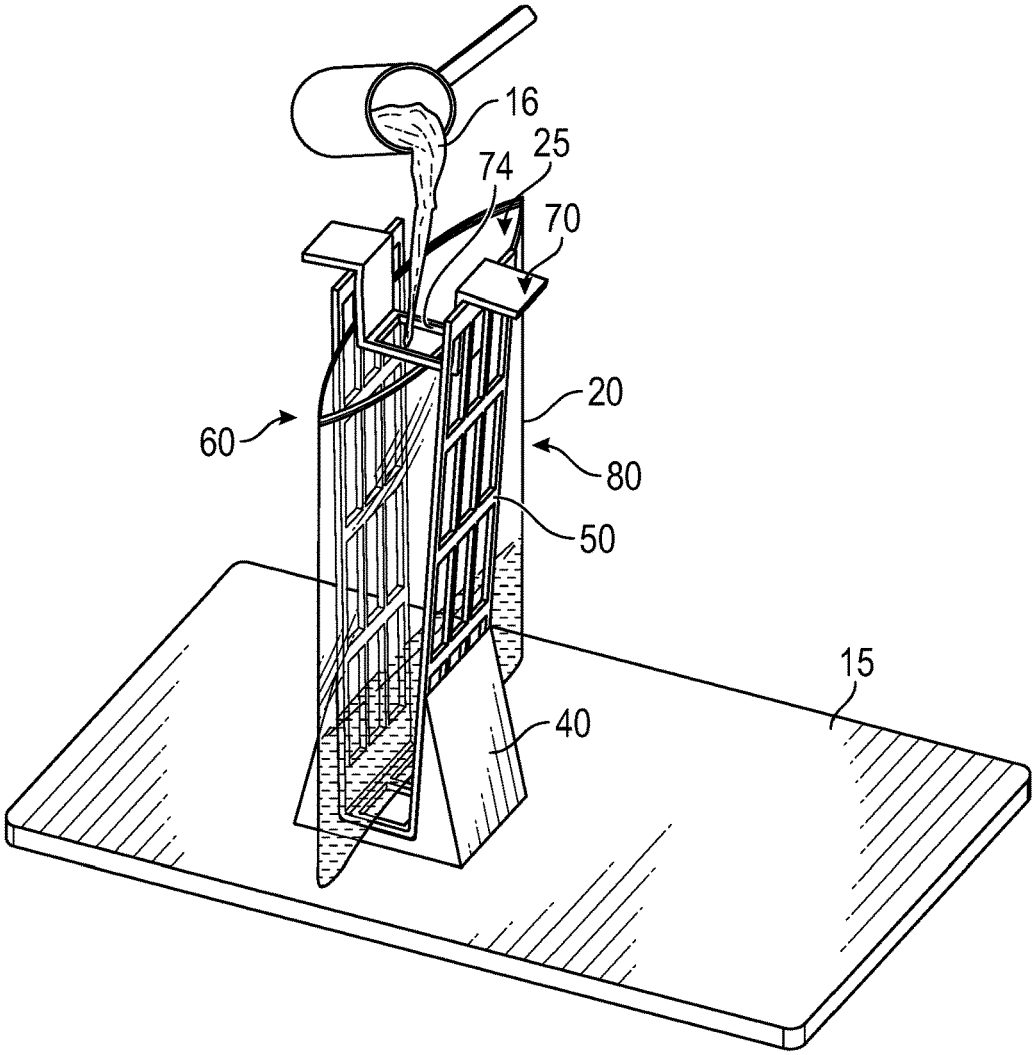
FIG. 1 is a perspective illustration of the invention, illustrating a substance being poured into a plastic bag while the plastic bag is supported by the invention on a support surface.
Figure 2:
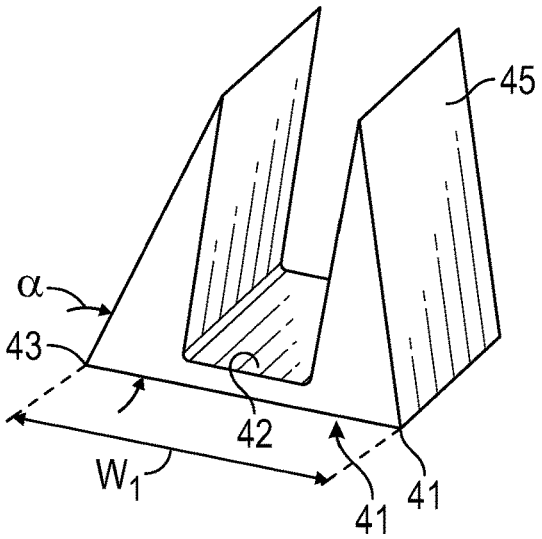
FIG. 2 is a perspective illustration of a base of the invention.
Figure 3:
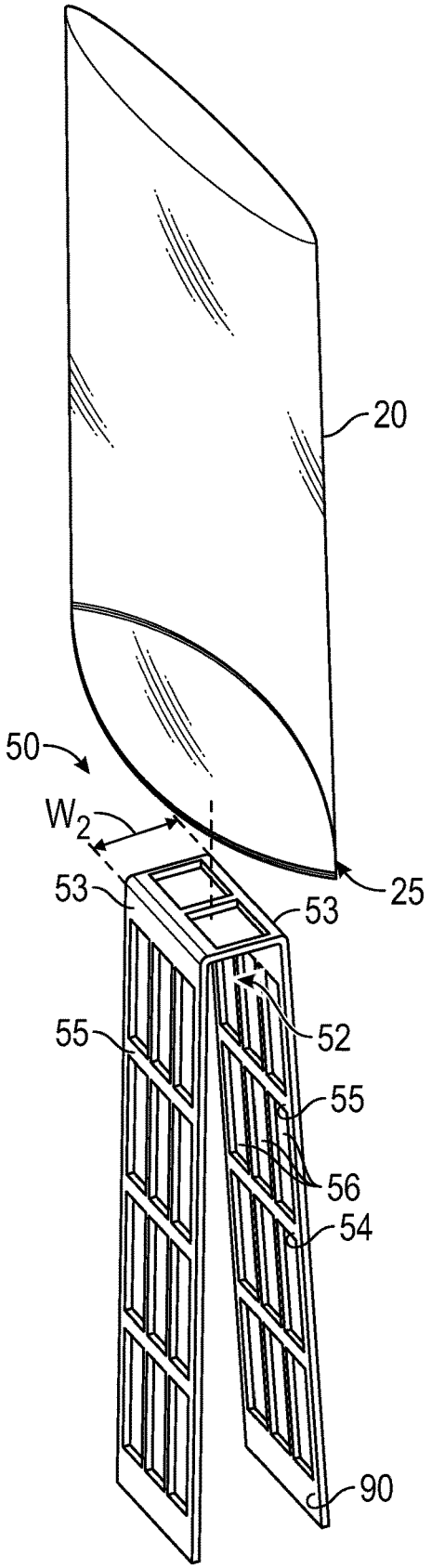
FIG. 3 is a perspective illustration of a support frame, illustrated with a plastic bag inverted above the support frame prior to insertion of the support frame into the plastic bag.
Figure 4:
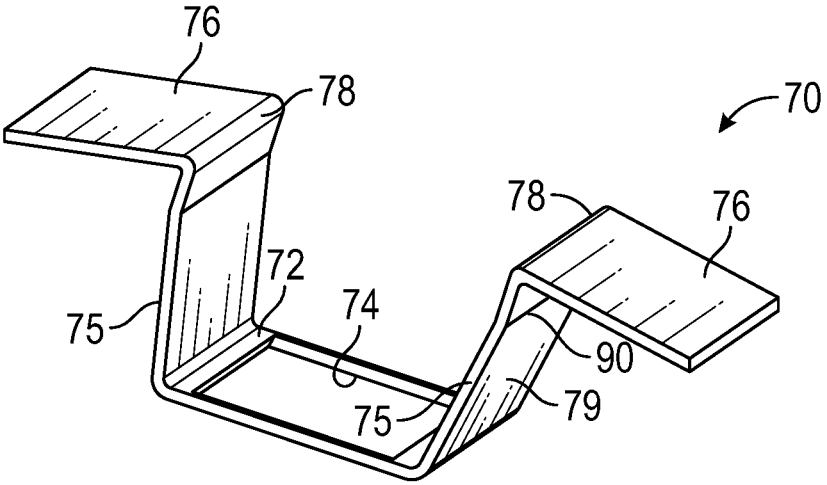
FIG. 4 is a perspective illustration of a funnel of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a bag holding system 10 for facilitating filling a plastic bag 20 with a substance 16 while the plastic bag 20 is supported on a support surface 15, such as a countertop. For example, the bag holding system 10 may be used for filling a standard sealable plastic one-gallon kitchen bag with hot grease from a pan. The bag holding system 10 further provides for facilitating washing of the plastic bag 20 in a dishwasher 30 that has a dish rack 35. Preferably a width $W_1$ of the bottom member 42 of the base 40 is at least 150% wider than a width $W_2$ of the bottom frame 52 of the support frame 50, such that the side members 45 of the base 40 extend upwardly at an angle $\alpha$ of ales than 90-degrees.

A base 40 (FIG. 2) has a bottom member 42 and two side members 45 that extend upwardly from the base 42 at two opposing sides 43 thereof. A bottom side 41 of the bottom member 42 is adapted for contacting the support surface 15, and is preferably an elongated rectangle with the opposing sides 43 being the long sides thereof. The base 40 is preferably made from a dishwasher-safe plastic material, such as polypropylene, BEPA-free plastic, or the like. In some embodiments the base 40 may be shaped so as to be extudable.

A V-shaped support frame 50 (FIG. 3) has a bottom frame 52 and two side frames 55 extending upwardly from the bottom frame 52 at two opposing sides 53 thereof. The support frame 50 is adapted to be inserted into the baes 40 between the two side members 45 of the base 40, the base 40 holding the support frame 50 in a substantially upright position 60. Preferably the support frame 50 is made from a resilient material such that the side frames 55 may be compressed towards each other enough to make mutual contact, and then released to return to an original uncompressed position 80. The support frame 50 is preferably made from a dishwasher-safe plastic material, such as polypropylene, BEPA-free plastic, or the like.

Figure 5:
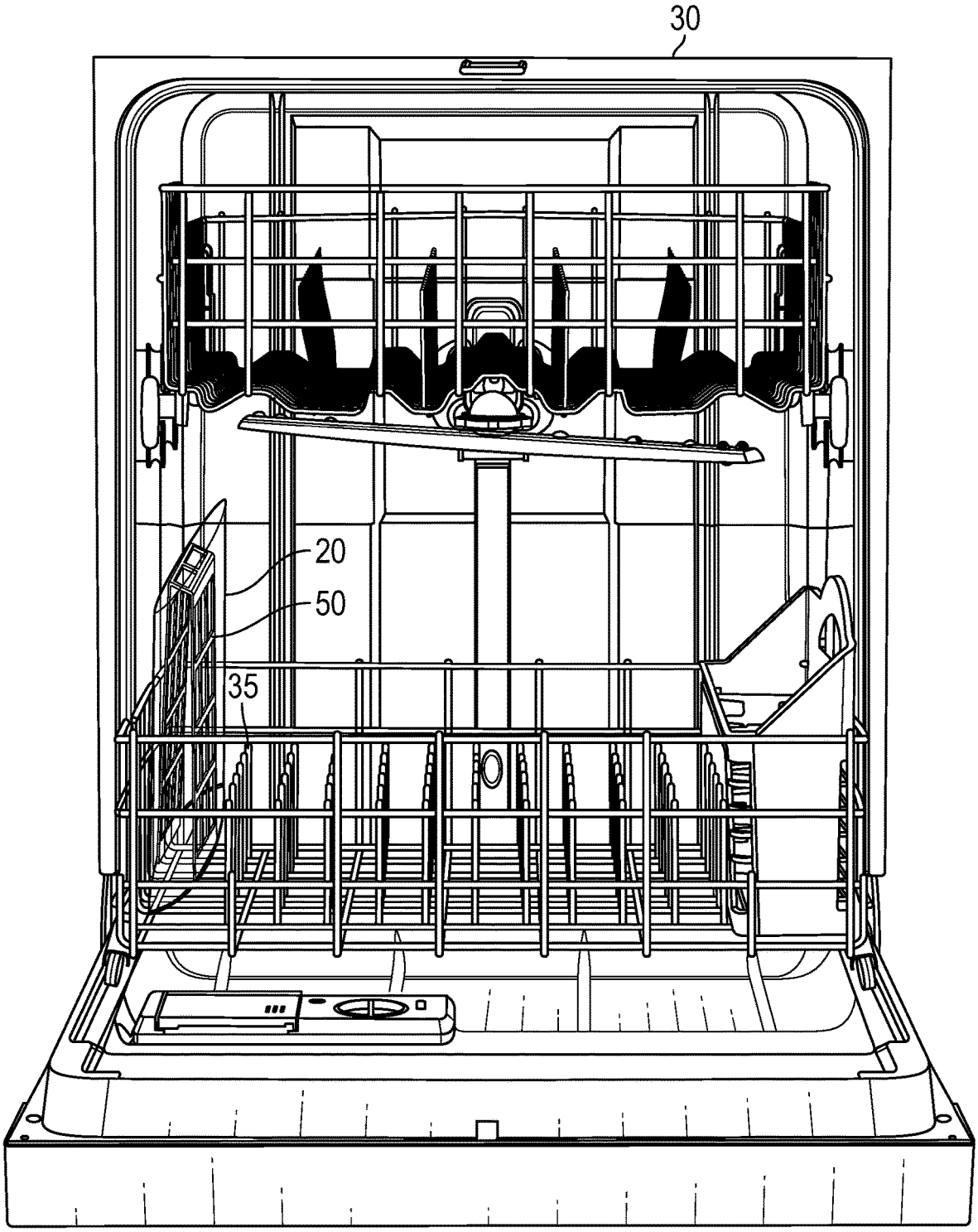
FIG. 5 is a perspective illustration of one use of the invention to facilitate cleaning of plastic bags in a dishwasher.

Preferably the side frame 55 includes one or more openings 56 for facilitating the dishwasher 30 washing the plastic bag 20, and specifically an inside surface of the plastic bag 20 (FIG. 5).

A resilient funnel 70 (FIG. 4) has bottom panel 72 with a fill aperture 74 therethrough and two side panels 75 projecting upwardly therefrom at two opposing sides 73 of the bottom panel 72. Each side panel further includes an outwardly-extending flange 76 at a top side 78 thereof. The base 40 is preferably made from a dishwasher-safe plastic material, such as polypropylene, BEPA-free plastic, silicon rubber, or the like.

As such, with the base 40 resting on the support surface 15, and with the support frame 50 inserted into the base 40 and held in the upright position 60, the funnel 70 is inserted into the open end 25 of the plastic bag 20. The plastic bag 20 is then captured between the two side panels 75 of the funnel 70 and the two side frames 55 of the support frame 50 (FIG. 1). The plastic bag 20 is Tillable by pouring the substance 16 into the aperture 74 of the funnel 70. In some embodiments the bottom panel 72 of the funnel 70 is sloped towards the aperture 74 so that liquid impacting the bottom panel 72 outside of the aperture 74 will roll down into the aperture 72 and ultimately into the plastic bag 20.

In an alternate use of the invention, illustrated in FIG. 5, the support frame 50 is inserted into the open top end 25 of the plastic bag 20. The support frame 50 and the plastic bag 20 are then inverted with the side frames 55 pressed towards each other so that the support frame 50 and the plastic bag 20 may be inserted between prongs of the dish rack 35 of the dishwasher 30. When released the resiliency of the support frame 50 pushes the side frames 55 outwardly towards the original uncompressed position 80 to engage the dish rack 35 to hold the plastic bag 20 in place inverted in the dish rack 35.

In some embodiments an outside surface 79 of the side panels 75 of the funnel 70 include horizontal ridges 90 adapted to cooperate with similar horizontal ridges 90 formed on an inside surface 54 of the side members 45 of the base 40, which inhibits movement of the plastic bag 20 when captured therebetween.

While a particular form of the invention has been illustrated and described, it will be apparent that various modifications can be made without departing from the spirit and scope of the invention. For example, the side members 45 of the base 40 are illustrated as triangular solids, but such side members 45 could include thinner walls angled upward, causing a gap between the side members 45 and the support frame 50, in which case spacers (not shown) or other means could be utilized to maintain the support frame 50 in the vertical position 60. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above.

The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A bag holding system for facilitating filling a plastic bag with a substance while the plastic bag is supported on a support surface, and for facilitating washing the plastic bag in a dishwasher having a dish rack, the system comprising:

a base having a bottom member and two side members extending upwardly from the base at two opposing sides thereof, a bottom side of the bottom member adapted for contacting the support surface;

a resilient, V-shaped support frame having a bottom frame and two side frames extending upwardly from the bottom frame at two opposing sides thereof, the support frame adapted to be inserted into the base between the two side members of the base to hold the support frame in a substantially upright position; and a resilient funnel having a bottom panel with a fill aperture therethrough and two side panels projecting upwardly therefrom at two opposing sides thereof, each side panel further including two outwardly-extending flanges at a top side thereof;

whereby with the base resting on the support surface, and with the support frame inserted into the base and held in the upright position, the funnel is inserted into an open end of the plastic bag, the plastic bag being captured between the two side panels of the funnel and the two side frames of the support frame, the plastic bag thereby fillable by pouring the substance into the aperture of the funnel;

and whereby with the support frame inserted into the open top end of the plastic bag, the support frame and plastic bag are inverted and resiliently retained within the dish rack to clean the plastic bag.

2. The bag holding system of claim 1 wherein a width of the bottom member of the base is at least 150% wider than a width of the bottom frame of the support frame, the side members extending upwardly at an angle of less than 90-degrees.

3. The bag holding system of claim 1 wherein the side frames include one or more openings for facilitating the dishwasher washing the plastic bag.

4. The bag holding system of claim 1 wherein the support frame is made from a resilient material such that the side frames may be compressed towards each other enough to make mutual contact and then released to return to an original uncompressed position.

5. The bag holding system of claim 1 wherein outside surfaces of the side panels of the funnel including horizontal ridges adapted to cooperate with horizontal ridges formed on an inside surface of the side members of the base to inhibit movement of the plastic bag when captured therebetween.

6. A bag holding system for facilitating filling a plastic bag with a substance while the plastic bag is supported on a support surface, and for facilitating washing the plastic bag in a dishwasher having a dish rack, the system comprising:

a base having a bottom member and two side members extending upwardly from the base at two opposing sides thereof, a bottom side of the bottom member adapted for contacting the support surface;

a resilient, V-shaped support frame having a bottom frame and two side frames extending upwardly from the bottom frame at two opposing sides thereof, the support frame adapted to be inserted into the base between the two side members of the base to hold the support frame in a substantially upright position, the side frames each including one or more openings for facilitating the dishwasher washing the plastic bag; and a resilient funnel having a bottom panel with a fill aperture therethrough and two side panels projecting upwardly therefrom at two opposing sides thereof, each side panel further including two outwardly-extending flanges at a top side thereof;

wherein a width of the bottom member of the base is at least 150% wider than a width of the bottom frame of the support frame, the side members extending upwardly at an angle of less than 90-degrees;

wherein the support frame is made from a resilient material such that the side frames may be compressed towards each other enough to make mutual contact and then released to return to an original uncompressed position;

wherein outside surfaces of the side panels of the funnel include horizontal ridges adapted to cooperate with horizontal ridges formed on an inside surface of the side members of the base to inhibit movement of the plastic bag when captured therebetween;

whereby with the base resting on the support surface, and with the support frame inserted into the base and held in the upright position, the funnel is inserted into an open end of the plastic bag, the plastic bag being captured between the two side panels of the funnel and the two side frames of the support frame, the plastic bag thereby Tillable by pouring the substance into the aperture of the funnel;

and whereby with the support frame inserted into the open top end of the plastic bag, the support frame and plastic bag are inverted and resiliently retained within the dish rack to clean the plastic bag.

* * * * *